US005522461A

United States Patent [19]

Carter et al.

[11] Patent Number: 5,522,461

[45] Date of Patent: Jun. 4, 1996

[54] MILL VALVE

[75] Inventors: Thurman B. Carter, Pearland; John D. Roberts, Spring, both of Tex.

[73] Assignee: Weatherford U.S., Inc., Houston, Tex.

[21] Appl. No.: 414,338

[22] Filed: Mar. 31, 1995

[51] Int. Cl.[6] ..... E21B 29/00

[52] U.S. Cl. ..... 166/298; 166/55.7

[58] Field of Search ..... 166/55, 55.1, 55.6, 166/55.7, 117.5, 117.6, 298

[56] References Cited

U.S. PATENT DOCUMENTS

| | | | |
|---|---|---|---|
| 2,103,622 | 12/1937 | Kinzbach . | |
| 2,770,444 | 11/1956 | Neal . | |
| 2,807,440 | 9/1957 | Beck . | |
| 2,882,015 | 4/1959 | Beck . | |
| 2,978,032 | 4/1961 | Hanna | 166/117.5 |
| 3,172,488 | 3/1965 | Roxstrom . | |
| 3,732,924 | 5/1973 | Chelette et al. | 166/55 |
| 3,908,759 | 9/1975 | Cagle et al. | 166/117.6 |
| 4,266,621 | 5/1981 | Brock | 175/329 |
| 4,733,732 | 3/1988 | Lynch | 175/9 |
| 5,392,858 | 2/1995 | Peters et al. | 166/55.1 X |
| 5,398,754 | 3/1995 | Dinhoble | 166/117.6 |
| 5,425,417 | 6/1995 | Carter | 166/117.6 |
| 5,429,187 | 7/1995 | Beagrie et al. . | |
| 5,431,220 | 7/1995 | Lennon et al. | 166/55.7 |
| 5,443,129 | 8/1995 | Bailey et al. | 175/45 |

OTHER PUBLICATIONS

"Coring Services," Weatherford, 1994.

"Casing Whipstocks," Eastman Whipstock, Composite Catalog 1976–1977, p. 2226.

"Product Catalog," Weatherford Petco, 1992, especially pp. 26–30.

"Bowen Whipstocks," Bowen Co., Composite Catalog, 1962–1963.

"Catalog 1958–59," Kinzbach Tool Co. Inc. 1958.

"Directional Drilling Tools," Homco Associated Oil Field Rentals, Composite Catalog 1964–1965, pp. 2391, 2392, 2394.

"Oilfield Services And Manufactured Products," Homco, 1984.

"A–Z Stub Type Whipstock," A–Z Int'l Tool Co., 1976–1977 Composite Catalog, p. 219.

"Weatherford Fishing and Rental Tool Services," Weatherford, 1993.

"Improved Casing Sidetrack Procedure Now Cuts Wider, Longer Windows," Cagle et al, Petroleum Engr. Int'l, Mar. 1979.

"Dual Horizontal extension drilled using retrievable whipstock," Cress et al, World Oil, Jun. 1993.

*Primary Examiner*—William P. Neuder
*Attorney, Agent, or Firm*—Guy McClung

[57] ABSTRACT

A downhole wellbore tool has been developed which has a lower movable valve apparatus which, when it contacts a member in a wellbore or in a tubular in a wellbore, is moved to close off fluid flow through the item to which the valve apparatus is attached. In one aspect, such a valve apparatus is used below a mill above which is positioned a downhole motor which rotates the mill for milling. Actuation of the valve apparatus results in a cessation of the circulation of the motive fluid flowing to and through the motor so that milling stops. In one aspect the valve is selectively operable so that milling may be resumed. In another aspect such a tool is useful for indicating a known location in a wellbore when a decrease or cessation in fluid flow or a decrease in pressure is noticed at the surface.

15 Claims, 6 Drawing Sheets

MILL VALVE

BACKGROUND OF THE INVENTION

FIELD OF THE INVENTION

This invention is related to milling methods, downhole mills, valves for such mills, downhole fluid flow controllers, depth indicators, and whipstocks.

DESCRIPTION OF RELATED ART

Milling tools are used to cut out windows or pockets from a tubular, e.g. for directional drilling and sidetracking; and to remove materials downhole in a well bore, such as pipe, casing, casing liners, tubing, or jammed tools or portions thereof. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge beneath the cutting blades and an upward flow of the discharged fluid in the annulus outside the tool removes from the well cuttings or chips resulting from the cutting operation.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented or mashed-in areas of casing or the like. Prior art sidetracking methods use cutting tools of the type having cutting blades and use a deflector such as a whipstock to cause the tool to be moved laterally while it is being moved downwardly in the well during rotation of the tool to cut an elongated opening pocket, or window in the well casing.

Certain prior art well sidetracking operations employ a whipstock and a variety of milling tools used in sequence. For example, in one typical operation, a packer is set in a wellbore at a desired location and acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore and a stinger at the bottom of the tool is oriented with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Pulling on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill the pilot lug or portion there of and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the initial window in the casing and smooth out the window-casing-open-hole transition area. The tool is then removed from the wellbore.

Prior milling methods, including but not limited to using a mill on coiled tubing, present a variety of problems.

Milling down too far on a concave member of a whipstock damages the concave.

Often when using a starting mill with coil tubing, it is difficult to accurately determine mill depth in a borehole and to determine whether the desired portion of a tubular has been properly milled out.

There has long been a need for an efficient and effective milling method in which the number of trips into the wellbore is reduced. There has long been a need for tools useful in such methods. There has long been a need for milling methods in which various items are easily and properly oriented in a wellbore. There has long been a need for tools useful in such orientation.

SUMMARY OF THE PRESENT INVENTION

The present invention, in one embodiment, is an apparatus with a tubular body with a mill and a central body bore running lengthwise through the body, the tubular body having a top for interconnection with other devices or tubulars above the apparatus and the tubular body having a bottom end; and a valve apparatus disposed at the bottom end of the tubular body for controlling fluid flow through the central body bore. In one aspect any known valve useful to control flow downhole is useful as the valve apparatus and, in certain embodiments, it is within the scope of this invention to use any such valve in addition to new valves described herein. Such apparatus may be actuable only once to stop flow or, in other embodiments, may be multiply selectively actuable over and over. In another aspect a valve is used which locks closed and stays closed upon backing off from the contact member or stop, i.e. it is not multiply selectively actuable. In one embodiment the mill is a starting mill.

In one aspect such an apparatus is interconnected with a typical downhole motor, e.g. a mud motor, located above the apparatus so that motive fluid flowing through the motor flows through the apparatus and out its bottom end through the valve apparatus. In one aspect such a motor-apparatus combination is connected to coiled tubing for use downhole.

In one embodiment the valve apparatus includes an outer valve housing which is releasably securable to the bottom end of the tubular body and an inner valving member movably disposed within the outer valve housing with an end portion protruding from and beyond the bottom end. The end portion is disposed and configured to contact an appropriate contact member or stop located on a tubular or on another tool or device, e.g. but not limited to a whipstock, so that as the apparatus is lowered and after the end portion contacts the contact member, the outer valve housing moves downwardly with respect to the inner valving member and the inner valving member contacts a lower inner shoulder of the tubular body, shutting off flow through the valve apparatus and closing off the bottom end of the tubular body to fluid flow through it. In one aspect the inner valving member has peripheral flow ports and a solid central member so that so long as the solid central member is spaced apart from the lower inner shoulder of the tubular body fluid flows through the tubular body, through the flow ports, and out through the end portion protruding from the tubular body. In one aspect a bearing is provided on a concave portion of a whipstock to provide a bearing surface for a mill as it mills out a portion of a tubular, e.g. casing, adjacent the concave member. In one aspect such a bearing or bearings surface is made of brass.

In one method using an apparatus as described above, a motor rotates the mill and, once fluid flow is stopped by relative movement of the inner valving member with respect to the outer valve housing, the motor is stopped due to the cessation of flow of motive fluid therethrough. Thus, by employing a contact member at a known location and depth within a tubular or within a wellbore, milling is stopped at a known, precise distance and location, producing a milled-out hole or window of accurate desired size.

In one aspect a system according to this invention has apparatus as described with indicator apparatus and control apparatus at the surface so that flow inhibition and/or cessation and/or pressure increase or decrease monitored at the surface due to the movement of the inner valving member provides a signal or signals indicative of depth of the valve apparatus, the motor, and the mill, indicative of the amount of milling accomplished; and indicative of the location of the apparatus. In one method, following flow inhibition or shut-off, the apparatus is slightly raised so that flow is again initiated or increased to circulate debris and cuttings up out of the wellbore or tubular. It is also within this invention's scope to raise the apparatus and then again lower it to re-contact the contact member to check that the initial contact occurred and was accurate.

In one embodiment a whipstock according to the present invention has one or more millable members on its concave portion to inhibit or prevent milling of the concave itself rather than the tubular portion to be milled. The millable member(s) also provides a surface abutting the mill and forcing the mill against the tubular to be milled. In one embodiment, the millable member(s) is made of a suitable bearing material, e.g. but not limited to brass, to ease and facilitate mill rotation, particular in those embodiments in which relatively low mill torque is developed. In one aspect the millable member(s) extend to a point below the level at which contacting the contact member stops the mill; thus preventing the mill from milling past the millable member(s) into the concave main body. It is within the scope of this invention to employ one continuous millable member disposed along the concave face or to use a series of spaced apart members which are sized, disposed, and configured so that the mill is always in contact with at least one of them and is forced against the tubular to be milled by one of them, yet the mill is not continuously required to mill a millable member in addition to milling the tubular to be milled.

In one method according to the present invention abutting a contact member or stop member with a valve as previously described provides for adjustment of downhole motor speed and torque. The motor can be used in combination with a mill or with no mill.

In another embodiment of a method and device according to this invention a valve apparatus (as previously described) is used with a tubular body as previously described (without a downhole motor and without a milling apparatus). The valve apparatus is moved down a wellbore or tubing or casing therein to contact a stop or associated valve apparatus at a known location in the wellbore or tubing or casing. Decrease or cessation in fluid flow and/or decrease in the pressure of flow is signalled to a surface apparatus. This also indicates that the valve apparatus is at the location of the stop (or associated valve apparatus). When the location of the stop is known, then the location of the valve apparatus is known.

It is, therefore, an object of at least certain preferred embodiments of the present invention to provide:

- New, useful, unique, efficient, nonobvious devices and methods for wellbore mills and milling methods;
- Such devices and methods for controlling fluid flow to a downhole motor, including but not limited to a motor used with a mill;
- Such methods and devices for accurate and precise downhole location, including but not limited to a location for milling;
- Such methods and devices with whipstocks with one or more millable members to facilitate milling and with a contact member for co-acting with a mill valve; and
- New, useful, unique, efficient, nonobvious devices and methods for controlling fluid flow through wellbore tools; for controlling downhole motors; and for indicating location in a borehole or tubular.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
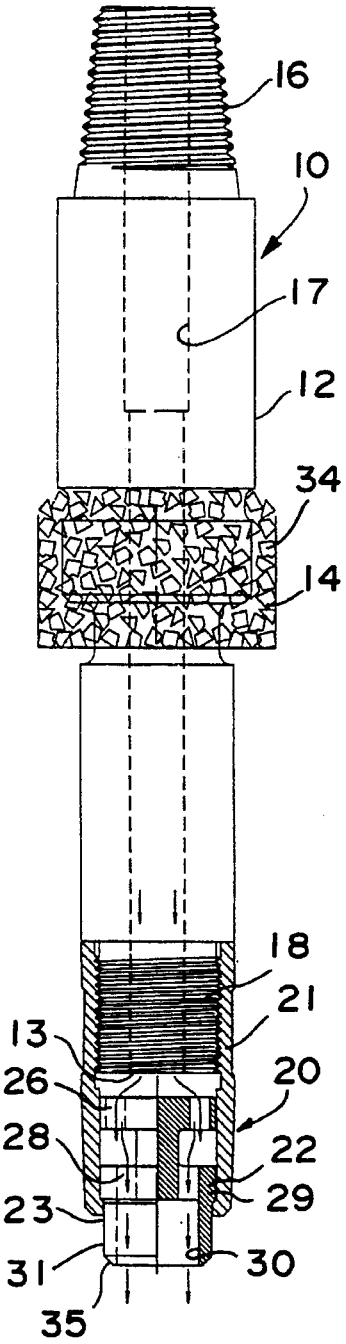
FIG. 1 is a side view partially in crosssection of an apparatus according to the present invention.
Figure 2:
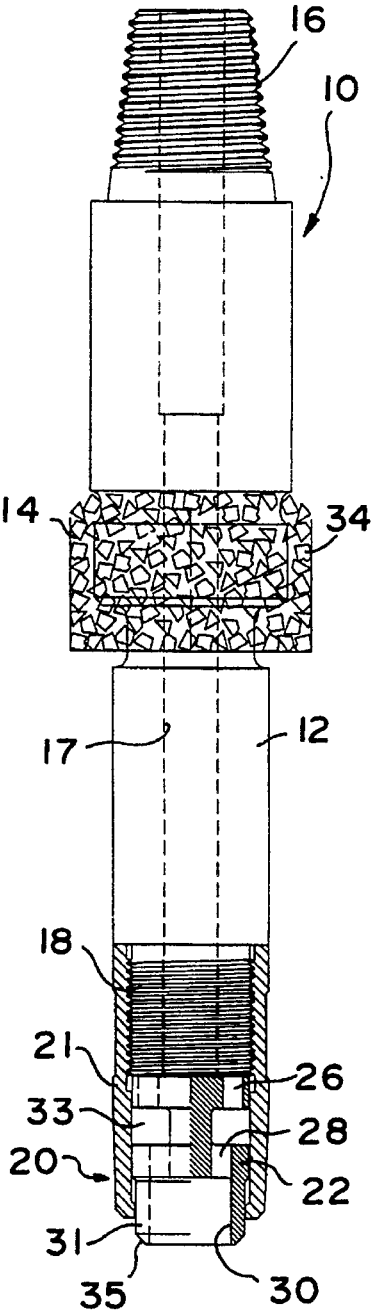
FIG. 2 is another side view of the apparatus of FIG. 1.
Figure 3:
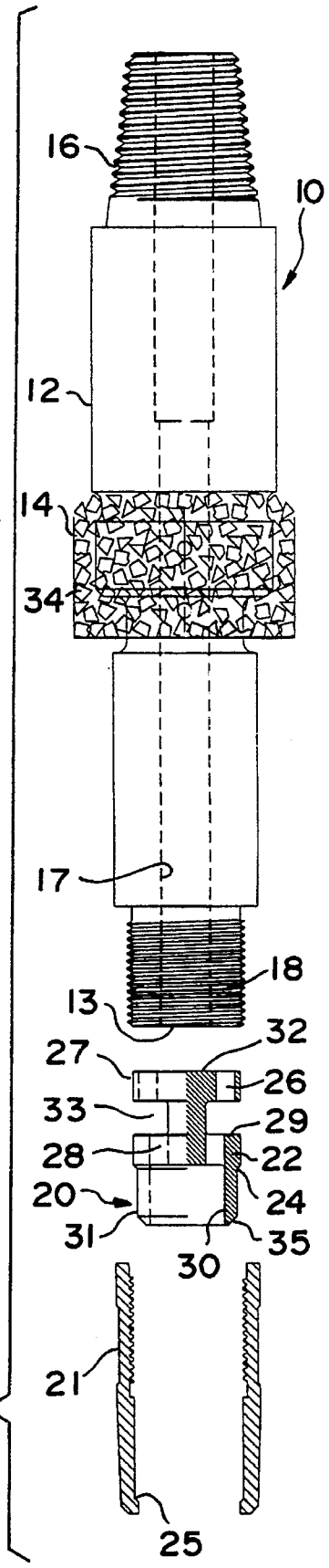
FIG. 3 is an exploded view in cross-section of the apparatus of FIG. 1.

Referring now to FIGS. 1–3, an apparatus 10 according to the present invention has a tubular body 12, a mill 14, an upper threaded end 16, a central flow channel 17, a lower threaded end 18, and a mill valve apparatus 20.

The mill valve apparatus 20 includes a valve housing 21 threadedly secured to the lower threaded end 18 of the apparatus 10 and an inner valving member 22 movably disposed within the valve housing 21 with an end portion 23 initially projecting therefrom. Initially gravity holds a shoulder 24 of the valving member 22 against a lip 25 of the valve housing 21, maintaining the valving member 22 within the valve housing 21 and preventing its exit therefrom.

Figure 10B:
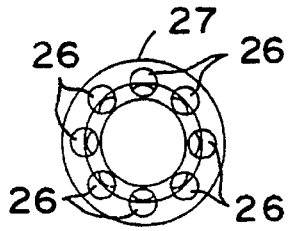
FIG. 10B is a top view of the inner valving member of FIG. 10A.
Figure 10A:
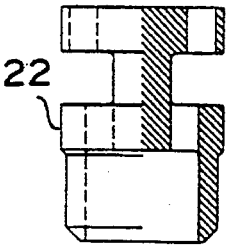
FIG. 10A is a side cross-sectional view of an inner valving member of the apparatus of FIG. 1.
Figure 10C:
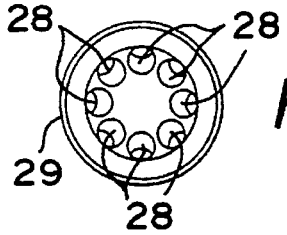
FIG. 10C is a bottom view of the inner valving member of FIG. 10A.

The valving member 22 has a plurality of flow ports 26 in a top body portion 27 and a plurality of flow ports 28 in a lower body portion 29 (see FIGS. 10A–C) which are in fluid communication with a central flow channel 30 in a bottom 31 of the valving member 22. The flow ports 26 are disposed so that a solid portion 32 of the top body portion 27 closes off an end opening 13 of the tubular body 12 when it abuts the tubular body 12.

As shown in FIG. 1 by the arrows, fluid flows down through the central flow channel 17, out through the end opening 13, into the valve housing 21, to the valving member 22, into and through the flow ports 26, through a space 33 between the top body portion 27 and the lower body portion 29, through the flow ports 28, into the central flow channel 30, and out from the bottom 31 of the valving member 22. As shown in FIG. 2 the valve housing 21 has moved down so that the solid portion 32 of the top body portion 27 abuts the lower end 18 of the tubular body 12 closing off the end opening 13 and preventing fluid flow from the end opening 13. A surface 35 on the bottom 31 is provided for contacting another member.

The mill 14 as shown is a typical starting mill faced with a multiplicity of pieces 34 of tungsten carbide material. It is within the scope of this invention for the mill 14 to be any type of mill and for it or surfaces or blades thereof or portions thereof to have cutting structure, cutters, or a cutting matrix, including but not limited to diamond material, ceramic material and hard facing material and/or to bear cutting inserts of any available shape, material, type, arrangement, combination, or pattern.

Figure 4:
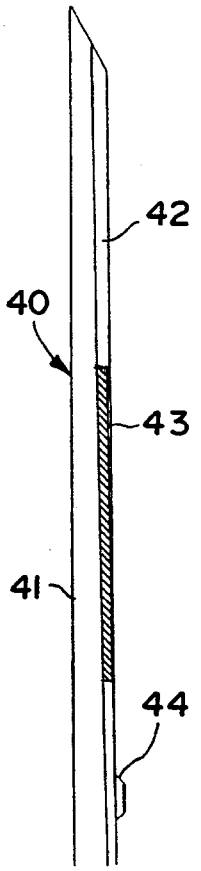
FIG. 4 is a partial side view of a whipstock according to the present invention.
Figure 5:
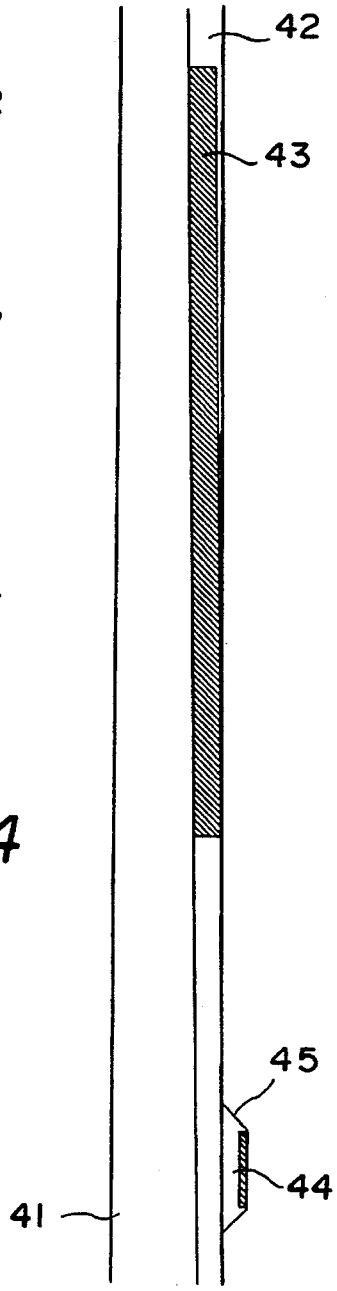
FIG. 5 is an enlargement of part of the whipstock of FIG. 4.

FIGS. 4 and 5 show a whipstock 40 according to the present invention with a main body 41, a concave portion 42, a lug member 43, and a contact member 44. In one preferred embodiment the lug member 43 is made of a suitable bearing material such as brass.

Figure 6:
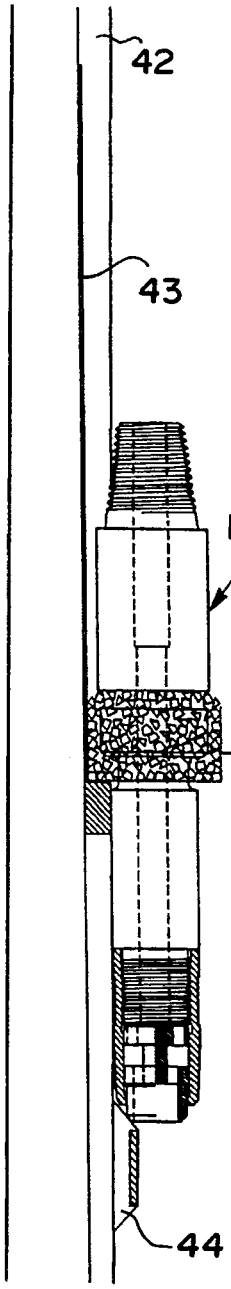
FIG. 6 is a side view of part of the whipstock of FIG. 4 with an apparatus as shown in FIG. 2.
Figure 7:
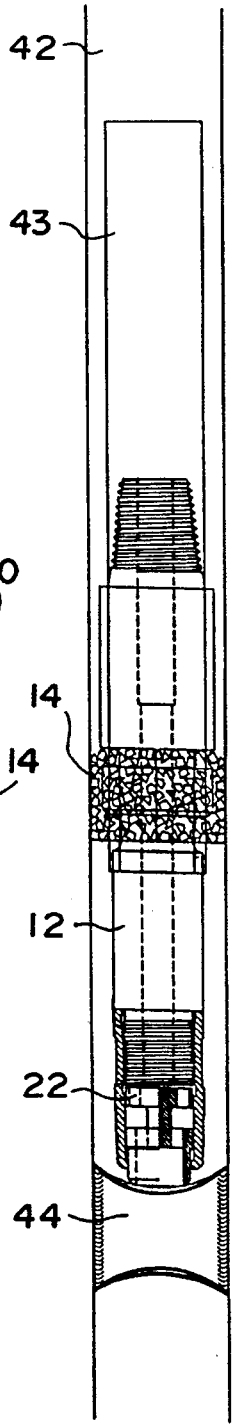
FIG. 7 is a frontal view of the items shown in FIG. 6.

As shown in FIGS. 6 and 7, an apparatus 10 has moved down the whipstock 40 cutting a window in an adjacent tubular, e.g. a casing (not shown). The majority of the lug member 43 has also been milled away, but preferably the contact member is located and the lug member extends sufficiently so that the mill 14 does not mill into the concave portion 42 and does not mill down past the lug member 43. The surface 35 of the valving member 22 has contacted an inclined surface 45 of the contact member 44 and the valving member 22 has moved so that it has closed off fluid flow through the apparatus 10.

Figure 8:
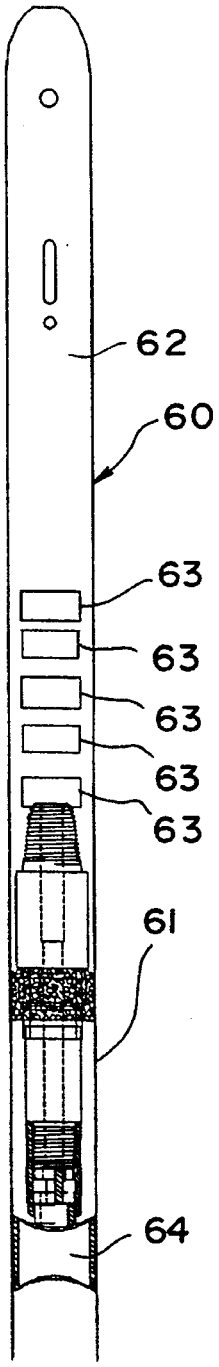
FIG. 8 is a partial front view of a whipstock and apparatus according to the present invention.

FIG. 8 illustrates another whipstock 60 according to the present invention with a main body 61, a concave portion 62, a plurality of spaced apart lug members 63 and a contact member 64. Preferably the lug members 63 are sized and positioned so that the mill 14 of the apparatus 10 is always abutting part of one of the lug members 63 so that it is held away from the concave 62 and so that the tubular body below the mill is held off of the concave.

Figure 9A:
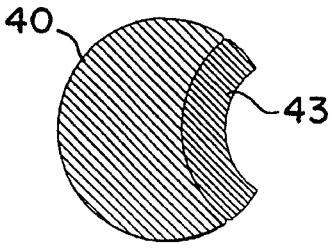
FIG. 9A is a crosssectional view of the whipstock of FIG. 4 according to the present invention.
Figure 9B:
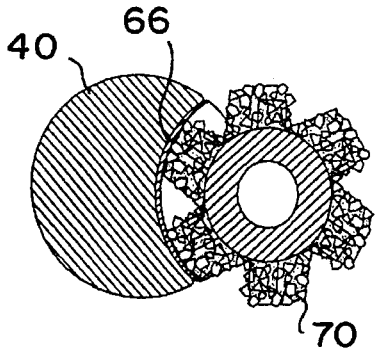
FIG. 9B is another crosssectional view of the whipstock of FIG. 9A with a mill contacting the whipstock.
Figure 9C:
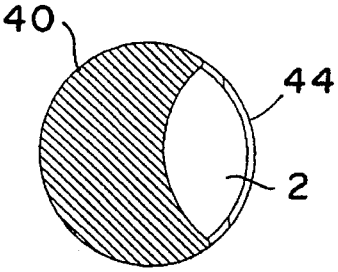
FIG. 9C is another crosssectional view of the whipstock of FIG. 9A.

FIGS. 9A–9C show a variety of crosssectional views through a whipstock such as the whipstock 40. FIG. 9A is a view through such a whipstock 40 and its lug member 43 prior to any milling of the lug member. FIG. 9B shows a ribbed mill 70 which has milled a portion of the lug member 43 leaving a relatively thin part 66 remaining along the concave member 42. FIG. 9C shows the contact member 44 on the whipstock 40 and illustrates a space Z between the contact member 44 and the whipstock 40 through which fluid is pumpable. This prevents the contact member 44 from providing a large surface against which fluid might be pumped creating a false pressure increase indication at the surface. Also, in this preferred embodiment, use of a curved contact member 44 whose arc completes a full circle with the whipstock 40 as shown in FIG. 9C makes it possible to easily roll the whipstock 40. Also, the contact member 44 spaces the concave member and its lug away from the ground, particularly during rolling of the apparatus. However it is within the scope of this invention to provide a solid contact member or stop with no space between it and the concave of a whipstock or other device with which the valve and/or valve and mill are used.

Figure 11:
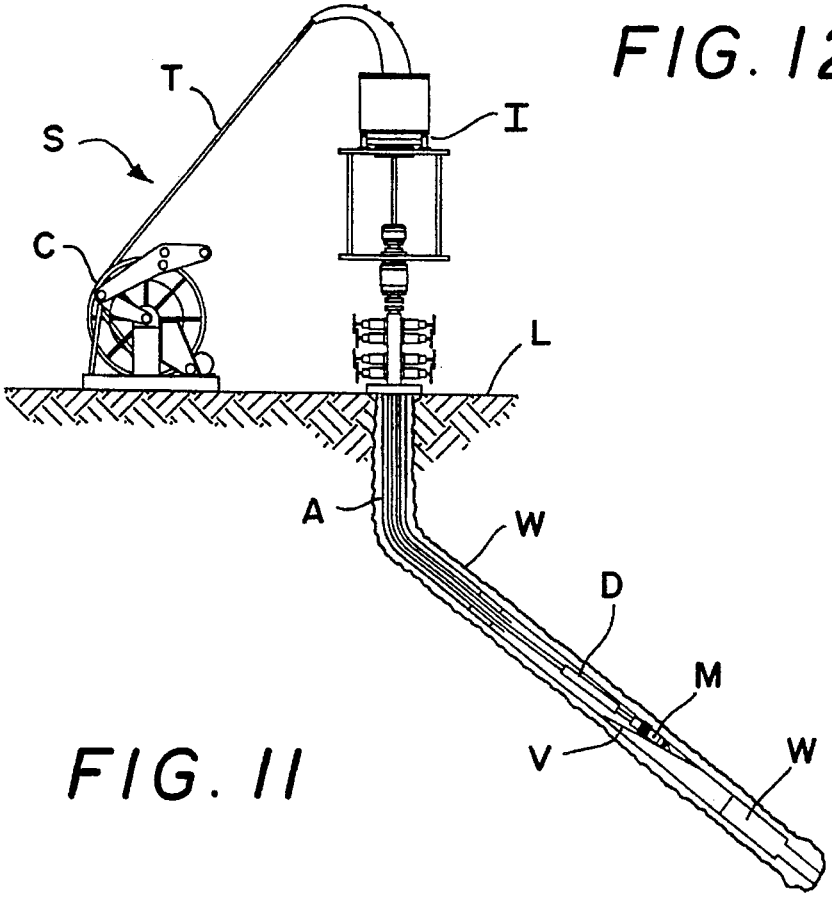
FIG. 11 is a system according to the present invention.

FIG. 11 illustrates a system S according to the present invention with a coil tubing unit C at ground level L and a string of coil tubing T extending from the coil tubing unit C, through a tubing injector I, into casing A in a wellbore W. A milling device M (like any device described or claimed herein with a mill valve as described or claimed herein) has been moved on the coil tubing string T to contact a concave member V of a whipstock W which has been set in the wellbore. A downhole motor D rotates the milling device M. The coil tubing T has a fluid flow bore therethrough along its length. The whipstock W may be set or re-set at any desired orientation so that milling may be accomplished at any desired location or azimuth.

Figure 12A:
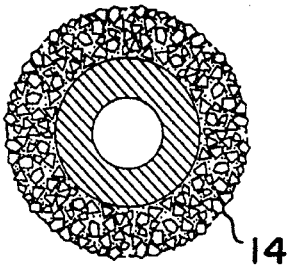
FIG. 12A is a cross-sectional view of a mill useful in systems according to the present invention.
Figure 12B:
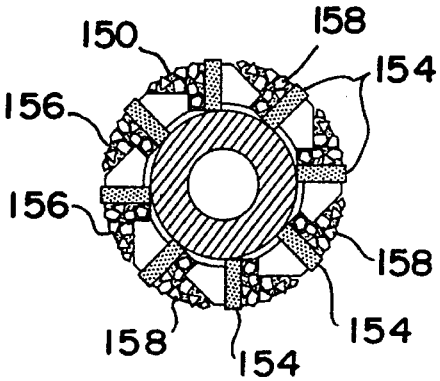
FIG. 12B is a cross-sectional view of a mill useful in systems according to the present invention.

FIG. 12A is a top view of a mill like the mill 14 of FIG. 1. FIG. 12B is a top view of a mill 150. The mill 150 has a plurality of pockets 152 around its outer periphery, each pocket holding one or more milling inserts 154 and an amount of material 156 with tungsten carbide pieces therein.

Figure 13A:
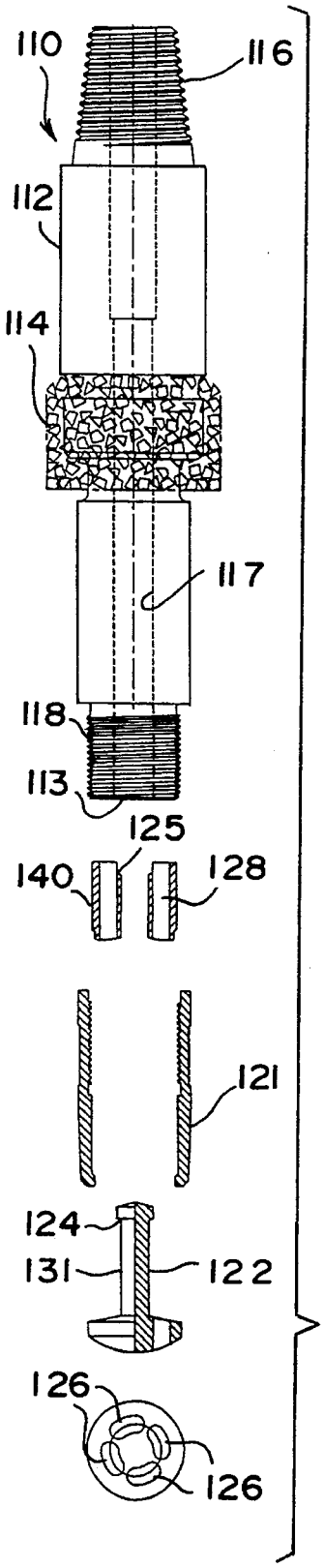
FIG. 13A is a side cross-sectional exploded view of an apparatus according to the present invention.
Figure 13B:
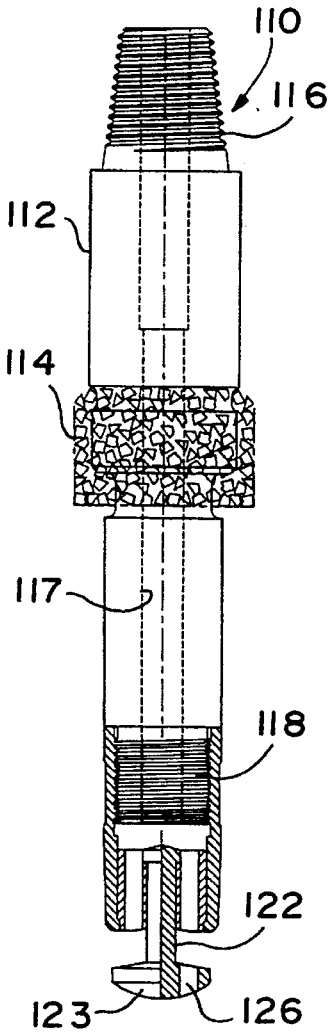
FIG. 13B is a side cross-sectional assembled view of the apparatus of FIG. 13A with a valve open.
Figure 13C:
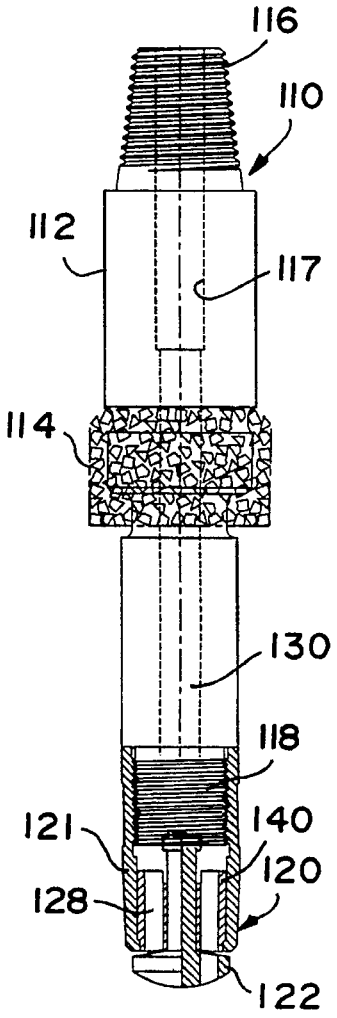
FIG. 13C is a side cross-sectional view of the apparatus of FIG. 13B with the valve closed.

Referring now to FIG. 13A–C, an apparatus 110 according to the present invention has a tubular body 112, a mill 114, an upper threaded end 116, a central flow channel 117, a lower threaded end 118, and a mill valve 120.

The mill valve 120 includes a valve housing 121 threadedly secured to the lower threaded end 118 of the apparatus 110 and an inner valving member 122 movably disposed within a bushing 140 in the valve housing 121 with an end portion 123 initially projecting therefrom. Initially gravity (an in certain embodiments the force of fluid flowing through the apparatus) holds a shoulder 124 of the valving member 122 against a lip 125 of the bushing 140 holding the valve open and maintaining the valving member 122 within the valve housing 121 and preventing its exit therefrom.

The valving member 122 has a stem 131 and a plurality of flow ports 126 in the end body portion 123 and the bushing 140 has a flow channel 128 which is in fluid communication with a central flow channel 130 in the tubular body 112 when the valve is open. The ports 126 prevent a false pressure increase reading at the surface. The shoulder 124 is disposed so that it closes off an end opening 113 of the channel 130 through the tubular body 112 when it abuts the end opening, closing the valve as shown in FIG. 13C.

Figure 14:
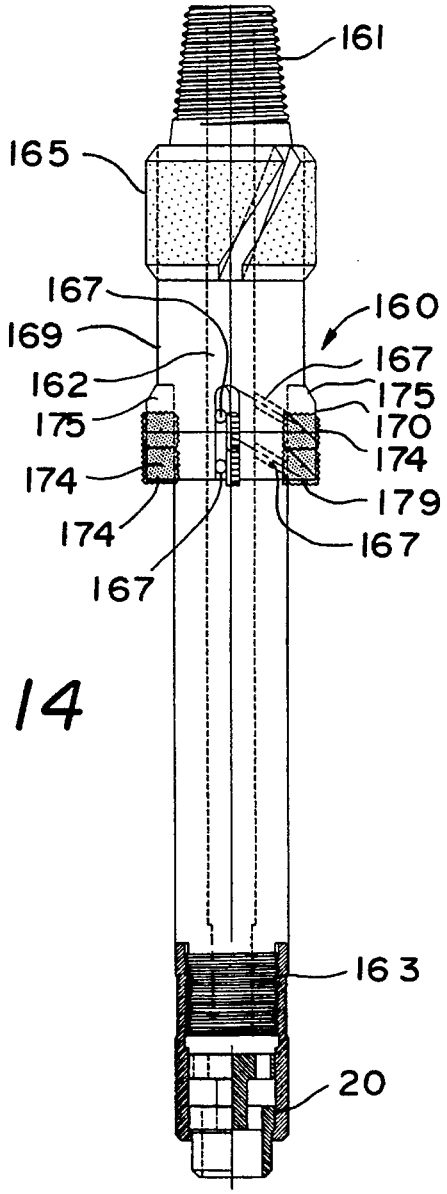
FIG. 14 is a side view partially in crosssection of an apparatus according to the present invention.

FIG. 14 shows an apparatus 160 according to the present invention with a tubular body 169 having an upper threaded end 161 and a lower threaded end 163. A stabilizer 165 is affixed to or formed integrally of the tubular body 169 as is a mill 179. A plurality of fluid flow ports 167 extend from a central channel 162 of the tubular body 169 and exhaust across and over inserts 174 on blades 175 of the mill 170. The apparatus 160 has a valve 20 as shown in FIG. 1 (and it may have any valve shown or claimed herein instead of the valve 20).

Figure 15:
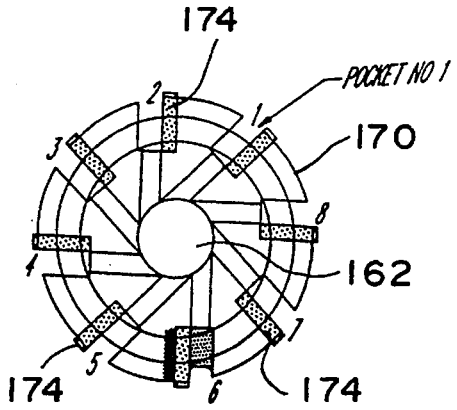
FIG. 15 is a schematic top view of a mill useful with the present invention.
Figure 16:
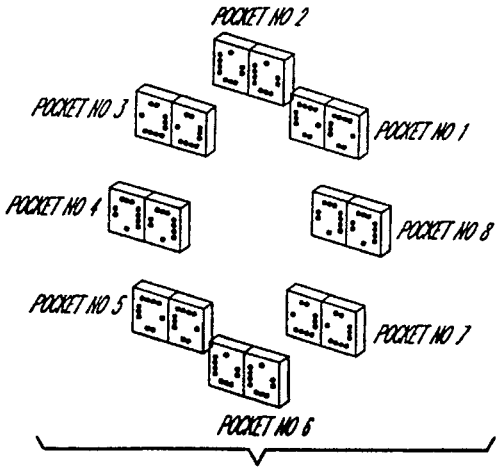
FIG. 16 is a schematic representation of inserts used with the mill of FIG. 15.

FIG. 15 is a cross-sectional top schematic view of the mill 170 with insert-exhaust pockets numbered 1–8. If fluid exhaust over the inserts is not desired, the exhausts may be filled with any suitable material. FIG. 16 illustrates schematically one pattern for inserts 174 in the pockets 1–8.

Figure 17A:
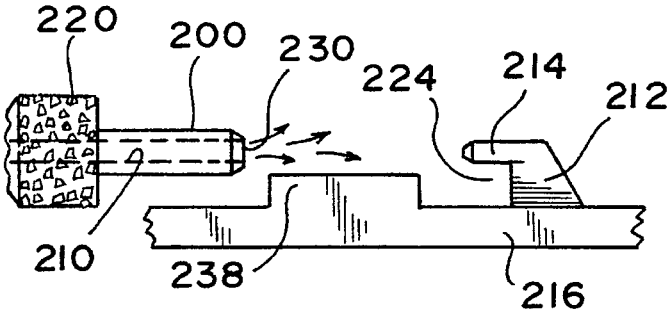
FIGS. 17A and 17B show a side cross-sectional view of a system according to this invention.
Figure 17B:
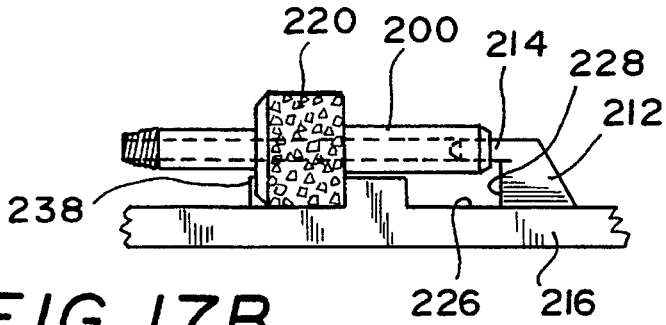

Referring now to FIGS. 17A and 17B another valve apparatus according to the present invention is shown (uphole is to the left in the drawing and downhole is to the right). A tubular body 200 with a mill 220 has a flow bore 210 therethrough and an end exit opening 230 for fluid flow. A stop 212 on a concave 216 has a finger 214. Movement of the tubular body 200 down onto the stop 212 results in the finger 214 moving into and closing off the exit opening 230 so that fluid flow ceases. Alternatively, the tubular body may move into a space 224 between the finger 214 and a concave surface 226. The various parts are sized so that fluid flow is cut off when the exit opening 230 and the end of the tubular body 200 abut a surface 228 of the stop 212 to close off flow. A brass lug 238 may be used (like the previously described lugs). Such apparatus may be used with the previously described embodiments, with or without a motor, with or without a mill.

Incorporated fully herein for all purposes are these U.S. applications co-owned with the present invention and application: Ser. No. 08/300,917 filed Sep. 6, 1994 entitled "Wellbore Tool Setting System"; and "Whipstock Side Support" filed on even date herewith.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A milling apparatus for milling out a portion of a tubular in a wellbore, the apparatus comprising a tubular body with a bore therethrough, the tubular body having a top end and a bottom end, the bore terminating at a bottom opening at the bottom end of the tubular body, a mill disposed on the tubular body, and a valve apparatus on the bottom end of the tubular body for closing off the bore of the tubular body to fluid flow.

2. The milling apparatus of claim 1 further comprising the valve apparatus including an outer valve housing and an inner valving member movable in the outer valve housing, the inner valving member having a top solid portion movable to close off fluid flow through the bottom opening of the tubular body, and the inner valving member having fluid flow ports therethrough in fluid communication with the bore of the tubular body prior to closing off of the bottom opening.

3. The milling apparatus of claim 2 further comprising the outer valve housing having a bottom end, and the inner valving member having a bottom end portion projecting out from and beyond the bottom end of the outer valve housing and movable into the outer valve housing to close off the fluid flow through the tubular body.

4. The milling apparatus of claim 1 wherein the valve apparatus further comprises the valve apparatus having an outer housing, an inner bushing in the outer housing with a central bushing bore therethrough and an annular flow channel therethrough between an exterior surface of the central bore and an interior surface of the inner bushing, and an inner valving member with a top end connected to a stem which is connected to a lower end portion, the stem movable in the central bushing bore so that the top end is movable to abut and close off fluid flow through the bore of the tubular body.

5. A milling system comprising a length of coiled tubing with a fluid flow bore therethrough, a downhole motor connected to the length of coiled tubing and in fluid communication with the central fluid flow bore of the coiled tubing, fluid flowable through the length of coiled tubing to power the downhole motor, the fluid flowable from the downhole motor, a milling apparatus with a tubular body and a fluid flow channel therethrough in fluid communication with the downhole motor and for rotation by the downhole motor, the milling apparatus including a mill valve at an end thereof, the mill valve actuable to close off fluid flow through the milling apparatus thereby closing off fluid flow through the downhole motor so that milling by the milling apparatus ceases.

6. The milling system of claim 5, the mill valve actuable by contacting a contact member exteriorly of the system.

7. The milling system of claim 6 wherein the mill valve is actuable by contacting a contact member on a whipstock set in a tubular or wellbore.

8. The milling system of claim 6 wherein the mill valve further comprises the valve apparatus including an outer valve housing and an inner valving member movable in the outer valve housing, the inner valving member having a top solid portion movable to close off fluid flow through the bottom opening of the tubular body, the inner valving member having fluid flow ports therethrough in fluid communication with the bore of the tubular body prior to closing off of the bottom opening, the outer valve housing having a bottom end, and the inner valving member having a bottom end portion projecting out from and beyond the bottom end of the outer valve housing and movable into the outer valve housing so that the outer valve housing closes off the fluid flow ports of the inner valving member.

9. The milling system of claim 5 further comprising a whipstock set in a tubular or wellbore for contact by the milling apparatus.

10. The milling system of claim 9, the whipstock further comprising a body with a concave portion, and a body contact member for contact by a valve apparatus of a milling tool, the valve apparatus having a housing, so that a part of the valve apparatus is movable into the housing against the body contact member.

11. The milling system of claim 10, the whipstock further comprising a bearing lug on the concave portion for contact by a milling tool to bear against the milling tool, and the body contact member positioned on the body for contact by a valve apparatus of a milling tool so that the milling tool does not mill past the bearing lug.

12. The milling system of claim 6 wherein the mill valve further comprises the valve apparatus having an outer housing, an inner bushing in the outer housing with a central bushing bore therethrough and an annular flow channel therethrough between an exterior surface of the central bore and an interior surface of the inner bushing, and an inner valving member with a top end connected to a stem which is connected to a lower end portion, the stem movable in the central bushing bore so that the top end is movable to abut and close off fluid flow through the bore of the tubular body.

13. A method for milling out a portion of a tubular member, the tubular member having a tubular longitudinal channel through its length from top to bottom, the method comprising inserting into the tubular longitudinal channel of the tubular member a milling system, the milling system including a length of coiled tubing with a fluid flow bore therethrough, a downhole motor connected to the length of coiled tubing and in fluid communication with the fluid flow bore of the coiled tubing, fluid flowable through the length of coiled tubing to power the downhole motor, the fluid flowable from the downhole motor, a milling apparatus with a tubular body and a central fluid flow channel therethrough in fluid communication with the downhole motor and for rotation by the downhole motor, the milling apparatus including a mill valve at an end thereof, the mill valve actuable to close off fluid flow through the milling apparatus thereby closing off fluid flow through the downhole motor so that milling by the milling apparatus ceases, and the mill valve actuable by contacting a contact member on a whipstock set in a tubular or wellbore, moving the milling system to a point at which the milling apparatus contacts the whipstock and mills out a portion of the tubular member, and further moving the milling system to a point at which the mill valve is actuated closing off fluid flow to the downhole motor effecting cessation of milling.

14. The method of claim 13 further comprising actuating the mill valve by contacting a contact member on the whipstock with a movable valving member of the mill valve.

15. The method of claim 13 further comprising raising the milling system to again open the mill valve to fluid flow so that the downhole motor again rotates the milling apparatus.

* * * * *